US007332853B2

(12) United States Patent
Van Rijswick et al.

(10) Patent No.: US 7,332,853 B2
(45) Date of Patent: Feb. 19, 2008

(54) HALOGEN DUAL-BEAM LAMP

(75) Inventors: Mathias Hubertus Johannes Van Rijswick, Eindhoven (NL); Denis Joseph Carel Van Oers, Eindhoven (NL); Andreas Martinus Theodorus Paulus Van Der Putten, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 313 days.

(21) Appl. No.: 10/550,350

(22) PCT Filed: Mar. 22, 2004

(86) PCT No.: PCT/IB2004/050312

§ 371 (c)(1),
(2), (4) Date: Sep. 23, 2005

(87) PCT Pub. No.: WO2004/086455

PCT Pub. Date: Oct. 7, 2004

(65) Prior Publication Data

US 2007/0008720 A1 Jan. 11, 2007

(30) Foreign Application Priority Data

Mar. 28, 2003 (EP) ..... 03100811

(51) Int. Cl.
*H01J 5/16* (2006.01)

(52) U.S. Cl. ..... 313/113

(58) Field of Classification Search ..... 313/113–116
See application file for complete search history.

*Primary Examiner*—Vip Patel

(57) ABSTRACT

The invention relates to a lamp-reflector unit (3) provided with a first (15) and a second light source (17) axially disposed on a lamp axis (1), and a reflector (7) with a reflecting part (13). A modification of the reflecting part of the reflector to a shape somewhere in between a parabolic shape and a shape of a straight cone achieves that light of a narrow beam, i.e. a beam with a beam angle less than 15°, is obtained from the first light source, while the light beam as obtained from the second light source does not show any "optical hole" in its center.

10 Claims, 2 Drawing Sheets

HALOGEN DUAL-BEAM LAMP

The invention relates to a lamp-reflector unit comprising:

a reflector with a neck, a light emission window, a reflecting portion arranged around an optical axis extending through the neck and perpendicular to the light emission window, which reflecting portion extends from the neck up to the light emission window;

a lamp comprising a first light source, and a second light source, said first and second light sources being located one behind the other, axially on the optical axis such that the first light source is located closer to the neck than the second light source;

a lamp cap mounted to the neck and provided with electrical contacts and with current conductors connected to the latter and to the respective light sources.

Such a lamp-reflector unit is known from EP-168015. The known unit comprises a low-power lamp of which the first and the second light source are both formed by a filament. The tow filaments are coiled bodies that form one whole because they have been manufactured from a single wire and are interconnected by a straight connecting portion of this wire. The two filaments have at least substantially the same resistance. The lamp in the known unit is mounted in the neck of the reflector so as to be displaceable along the optical axis. The reflector has a focus, so that a mutual displacement of the lamp and the reflector along the optical axis can locate one of the filaments in the focus so as to obtain a desired light beam having a narrow beam angle from the unit. The mutual displacement of the lamp and the reflector, or alternatively a switching between the filaments, renders it possible to vary the beam angle of the light beam somewhat. Alternatively, it also provides a possibility of a mutual displacement of the lamp and the reflector in the case of failure of the filament located in a focus of the reflector such that the focus will be located on the other, still intact filament, so that as it were a double operational life of the lamp is achieved. It is a disadvantage that the known unit has a comparatively complicated construction. Another disadvantage of the known unit is that it is not possible to obtain a light beam without an "optical hole" from each of the individual light sources by simply switching between the filaments of the two light sources. An optical hole is a central portion in the light beam having a comparatively low light level. To avoid this optical hole upon switching between the light sources, a mutual displacement of the lamp and the reflector is required in the known unit.

It is an object of the invention to provide a lamp-reflector unit of the kind described in the opening paragraph in which the above disadvantages have been counteracted. To achieve this, the unit of the kind described in the opening paragraph is characterized in that the reflecting portion is formed in accordance with a body of revolution about the optical axis of a curve which, seen in a longitudinal sectional view of the reflector through the optical axis, extends between a starting point on the neck and an end point on the light emission window, such that by means of auxiliary functions of:

a straight line section with n line points extending between the starting point and the end point;

a line section of a parabola with n parabola points extending between the starting point and the end point, having a parabola axis coinciding with the optical axis and having a focus F on the optical axis;

each individual point $K_n$ on the curve lies at a distance $x.D_n$ from a parabola point $P_n$ and at a distance $(1-x).D_n$ from a line point $L_n$, measured along a straight connecting line $V_n$ between $P_n$ and $L_n$ wherein $V_n$ lies in the plane of the longitudinal section and is perpendicular to the straight line section, wherein $D_n$ is the distance between $P_n$ and $L_n$ measured along $V_n$, and wherein x is substantially constant for the entire curve and has a value in a range of $0.25 \leqq x \leqq 0.75$. In other words, the reflecting portion of the reflector is deformed by the factor x from a pure parabolic shape towards a straight conical shape, the value of x lying within the range given above. The first light source in the lamp-reflector unit according to the invention is designed to generate a narrow light beam, i.e. a light beam with a beam angle of at most 15°. The lamp-reflector unit then serves as a spotlight. The second light source in the lamp-reflector unit according to the invention is designed for generating a wide light beam, i.e. a light beam with a beam angle of at least 20°. If the reflector has a straight conical shape, the unit would generate substantially the same light beam from the first and from the second light source. If the reflector is parabolically shaped, the first light source situated on the optical axis and in the focus would yield a narrow, parallel light beam. The second light source situated on the optical axis but not in the focus, however, would yield a light beam with an optical hole. Since the reflector of the lamp-reflector unit according to the invention has been given the shape slightly deviating from the parabola, the first light source generates a light beam with a somewhat wider, but still very acceptable narrow beam angle of approximately 10°, while at the same time the optical hole has disappeared from the light beam of the second light source. The unit with the reflector shaped in accordance with the main claim is of a comparatively simple construction. The lamp-reflector unit according to the invention renders it possible to operate the first and the second light source independently of one another, thus rendering possible an instantaneous switching from a narrow light beam to a wide light beam, the latter having no optical hole. Such an instantaneous switch-over is frequently used in particular in automobile headlights, where a switch-over from low beam to driving beam often takes place. The unit according to the invention is accordingly suitable for such an application. It is alternatively possible to operate the first and the second light source simultaneously. The lamp is preferably fixed with its end portion in the neck of the reflector, which achieves a permanent accurate positioning of the light sources in the reflector such that the desired light beams issue from the unit.

In an embodiment of the lamp-reflector unit according to the invention, the latter is characterized in that, viewed in the longitudinal section, a line through the starting point and through the focus F encloses an angle $\alpha_1$ with the optical axis, and in that a further line through the end point and through the focus F encloses an angle $\alpha_2$ with the optical axis, wherein $\alpha_1$ lies in a range of 30° to 50° and $\alpha_2$ in a range of 40° to 60°. It was found that reflectors with favorable light output, light beam characteristics, dimensions, and length/width ratios can be obtained when $\alpha_1$ and $\alpha_2$ lie in these ranges. If $\alpha_1$ is below 30°, the neck of the reflector will have an unnecessarily narrow opening, because the reflecting portion adjacent the opening falls within the light shadow of the first light source. The narrow opening hampers the introduction of the lamp into the reflector. If $\alpha_1$ is above 50°, the opening in the neck is too wide, so that light will be incident next to the reflecting surface, which leads to light losses. If $\alpha_2$ is above 60°, the reflector has a comparatively small length, so that a comparatively major portion of the light issues directly from the light emission window, i.e. without reflection against the reflecting surface, and is not used for the light beam, thus leading to more light losses. If $\alpha_2$ is below 40°, the reflector is comparatively long without any significant accompanying gain in light output.

An embodiment of the unit is characterized in that the lamp is a halogen incandescent lamp. The light sources, i.e. filaments of an incandescent lamp can be made to lie accurately on the optical axis over their entire length, so that a desired, circularly symmetrical light beam can be obtained in a comparatively simple manner. Preferably, the filaments are each manufactured from a separate wire, so that they are not necessarily interconnected by an intermediate portion. Power losses in the intermediate portion, such as those occurring in the known lamp, are counteracted thereby. At the same time, a higher degree of freedom in lamp design is achieved, for example a different watt rating for the individual filaments, and a compromise between the desired properties for the various components of the units is prevented. The desired wire diameter and the desired wire material may be chosen for each filament and for an intermediate portion, if present, for each wattage.

Preferably, the halogen incandescent lamp is a dual-filament halogen automobile lamp such as, for example, a modified version of a conventional H4 lamp. The conventional H4 lamp is used for automobile lighting and has the advantage that the dimensions and shape of the lamp are constant, as described in the standard documents E/ECE/TRANS/505. The conventional H4 lamp is modified internally only, whereas its external dimensions and the like remain unchanged. The low-beam cap is removed from the conventional H4 lamp, the two filaments are placed in one another's extended directions, and a black coating on the lamp has been omitted. An advantage of the use of the modified H4 lamp is that it can be manufactured on the existing H4 production lines. The omission of a few manufacturing steps in the known, universal production process of the H4 lamp renders it possible to manufacture the modified H4 lamp in a simple and inexpensive manner with a high reproducibility, the more so since large-scale manufacturing installations are already available, so that comparatively large investments are counteracted.

In a favorable embodiment, the lamp-reflector unit according to the invention is characterized in that the reflecting portion is subdivided into p facet rings, wherein the curve is approximated in that each facet ring p, seen in the longitudinal section, is oriented along a respective tangent line m to the curve halfway the relevant facet ring p. As a result, the lamp-reflector unit has the advantages that an (indistinct) image of the light source projected on an object illuminated by the lamp-reflector unit is counteracted and that the lamp-reflector unit is less sensitive to disturbances in the light beam if the light sources are not accurately positioned on the optical axis. These advantages may be alternatively achieved if the lamp-reflector unit according to the invention is characterized in that the reflecting portion is subdivided into r axial segments. Said advantages are realized to an even higher degree through a simultaneous implementation of the above measures, whereby the reflecting portion is subdivided into a p.r facet matrix.

In another embodiment, the lamp-reflector unit according to the invention is characterized in that the lamp has a translucent wall comprising a first and a second wall portion which surround the first and the second light source, respectively, wherein at least one wall portion has a spectrally modifying effect on light originating from the light source and passing through the relevant wall portion. Such a spectrally modifying effect may be achieved in a simple manner in that at least one of the wall portions has a coating, for example an interference coating or an absorption coating, which causes a change in color and/or color temperature of the light. It is alternatively possible that the first wall portion and the second wall portion have mutually different glass compositions.

Embodiments of the lamp-reflector unit according to the invention are diagrammatically shown in the drawing, in which FIG. 1 is a longitudinal sectional view of an embodiment of the lamp-reflector unit according to the invention;

Figure 1:
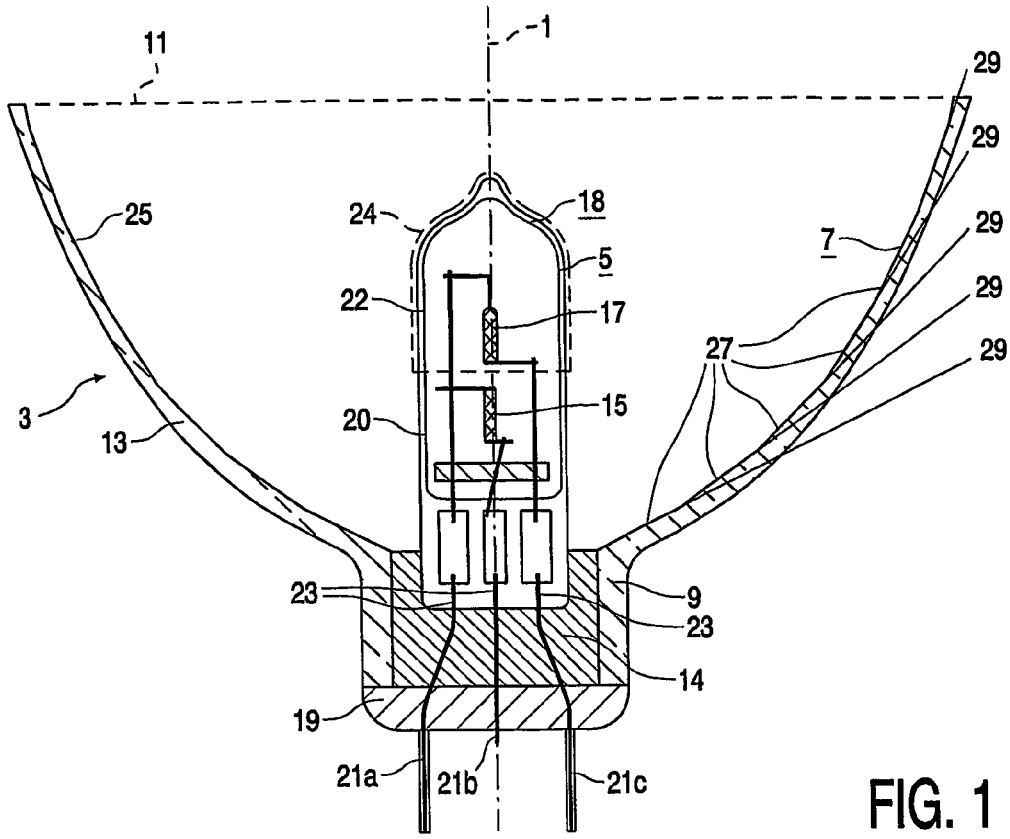
Figure 2:
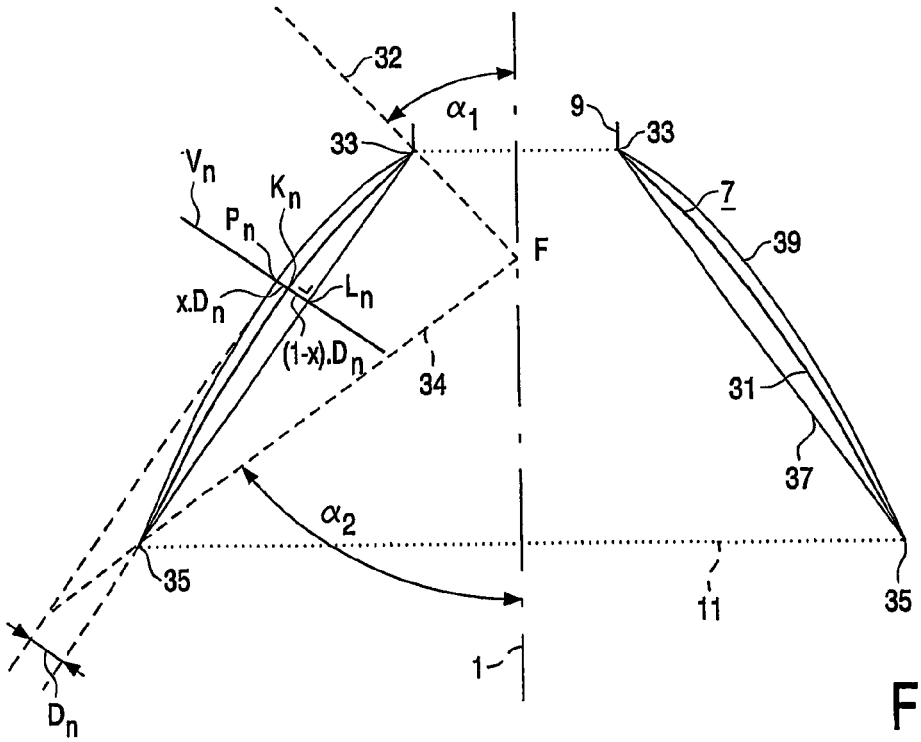
FIG. 2 is a reconstruction drawing of the curve of FIG. 1.
Figure 3A:
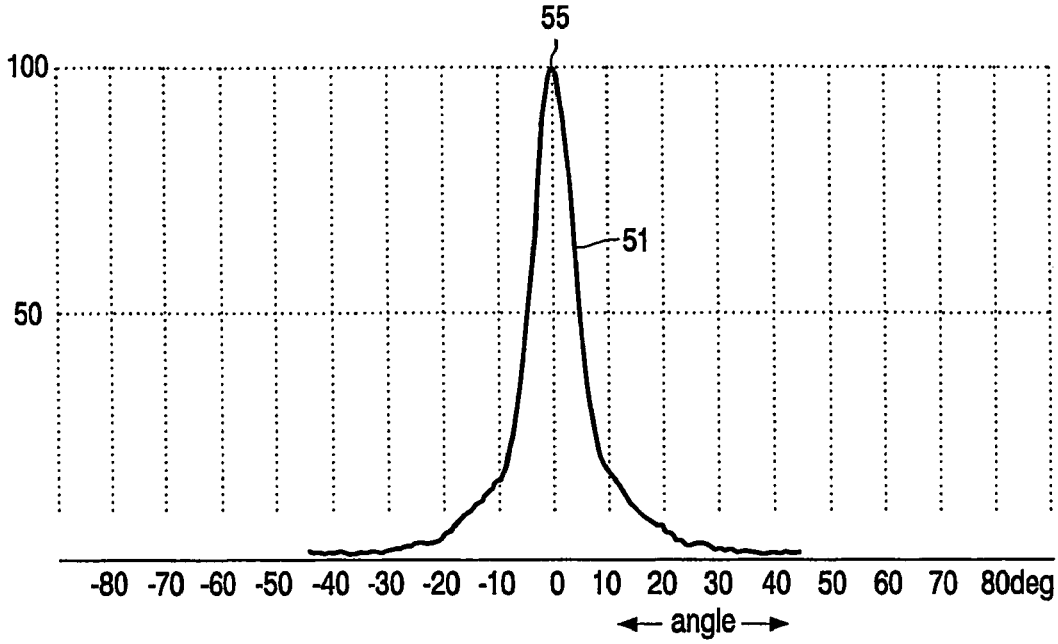
FIG. 3A is a first beam characteristic obtained from the lamp-reflector unit of FIG. 1.
Figure 3B:
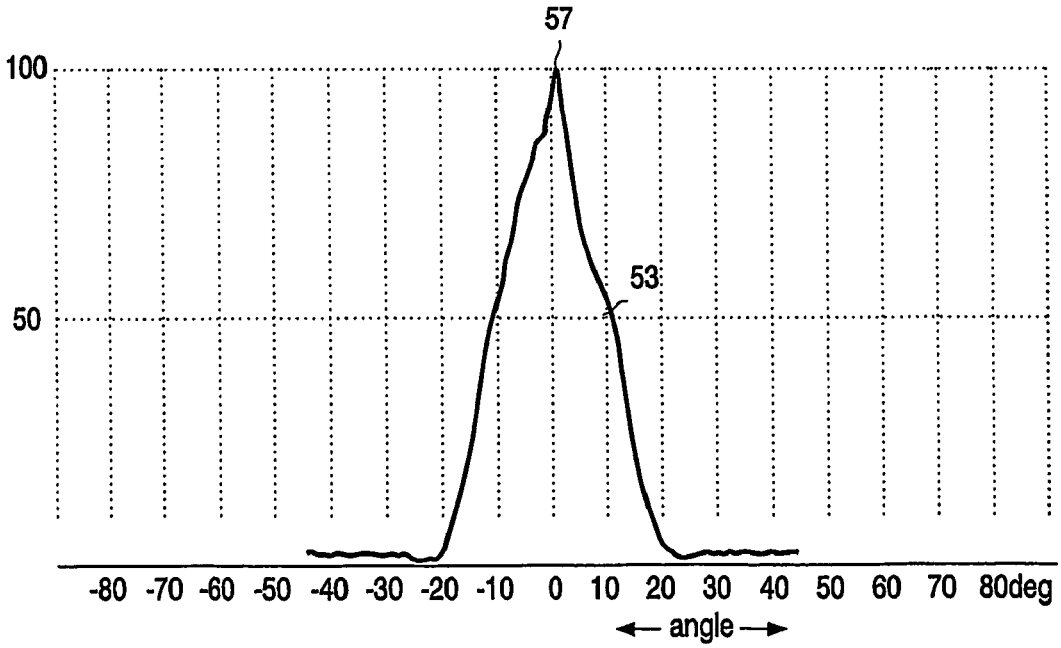
FIG. 3B is a second beam characteristic obtained from the lamp-reflector unit of FIG. 1.

FIG. 1 is a longitudinal sectional view through an optical axis 1 of a lamp-reflector unit 3 comprising a lamp 5, a reflector 7 with a neck 9, a light emission window 11, and a reflecting portion 13 around the optical axis 1 extending from the neck up to the light emission window. The optical axis extends through the neck and is perpendicular to the light emission window. The lamp is fixed in the neck of the reflector with cement 14 and comprises both a first light source 15 and a second light source 17, filaments in the Figure. It is alternatively possible that the light sources are each accommodated in a separate lamp. The first and the second light source are arranged on the optical axis one behind the other, at an axial distance from one another of approximately 6.5 mm in the Figure, such that the first light source is situated closer to the neck than the second light source. The light sources are each manufactured from a separate wire. The lamp in the Figure is a low-voltage, i.e. 12 V halogen incandescent lamp, in this case a modified H4 lamp with a length of approximately 50 mm and a maximum diameter of approximately 22 mm. The filaments often have a rated power in a range of 20 to 100 W, the first light source in the Figure having a rated power of 35 W and the second light source a rated power of 50 W. The lamp 5 has a wall 18 comprising a first wall portion 20 cylindrically surrounding the first light source 15 and a second wall portion 22 substantially surrounding the second light source 17. The second wall portion has an interference coating 24 which transmits a major portion of the light originating from the second light source and which causes a change in color temperature of the light from approximately 2900 K to approximately 4000 K. Light originating from the first light source will mainly pass through the first wall portion to the exterior of the lamp without modification. The first light source generates a narrow light beam and the second light source a wide light beam during lamp operation, with respective beam characteristics as shown in FIGS. 3A and 3B. The neck 9 is provided with a lamp cap 19 comprising electrical contacts 21*a*, 21*b*, 21*c*. The electrical contacts are connected to the relevant light sources via respective current conductors 23 such that the first and/or the second light source can be independently lit. This renders it possible for both light sources to be simultaneously operating, whereby a light beam of comparatively high luminous intensity is obtained. The reflecting portion is shaped in accordance with a body of revolution about the optical axis of a specific curve as shown in FIG. 2. The reflecting portion is provided with vapor-deposited aluminum 25 as a reflecting layer, but alternatively the reflecting layer may be an interference coating. The reflector is furthermore built up from p facets 27 which are oriented along lines 29 tangent to the specific curve of the reflector.

FIG. 2 diagrammatically shows a curve 31 which, seen in longitudinal section of the reflector taken through the optical axis, extends between a starting point 33 on the neck 9 and an end point 35 on the light emission window 11 of the reflector 7. The curve is defined by means of a straight line section 37 with n line points extending between the starting point and the end point and a parabolic line section 39 with n parabola points extending between the starting point and the end point. The parabolic line section 39 has a parabola axis coinciding with the optical axis 1 and a focus F on the optical axis. Each individual point $K_n$ on the curve 31 lies at a distance $x.D_n$ from a parabola point $P_n$ and at a distance $(1-x).D_n$ from a line point $L_n$, measured along a straight connecting line $V_n$ between $P_n$ and $L_n$. $V_n$ then lies in the plane of the longitudinal section and is perpendicular to the straight line section 37, $D_n$ being the distance between $P_n$ and $L_n$ measured along $V_n$. x is substantially constant for the entire curve and has a value in a range of $0.25 \leqq x \leqq 0.75$, in the Figure a value of 0.4. The size of the reflecting portion of the reflector is determined by means of the parabolic line section 39. The length of the parabolic line section is determined by means of a line 32 through the starting point 33 and the focus F which encloses an angle $\alpha_1$ with the optical axis, and a further line 34 through the end point 35 and the focus F which encloses an angle $\alpha_2$ with the optical axis, where $30° \leqq \alpha_1 \leqq 50°$ and $40° \leqq \alpha_2 \leqq 60°$, in the Figure $\alpha_1$ is 40° and $\alpha_2$ is 50°.

FIGS. 3A and 3B show a first beam characteristic 51 obtained from the first light source and a second beam characteristic 53 obtained from the second light source, respectively, of the lamp-reflector unit of FIG. 1. The first beam characteristic 51 has a peak value 55 which is standardized to 100. The width of the beam having a value of up to 50% of the peak value is the beam angle, which beam angle is approximately 10° for the first beam characteristic. The second beam characteristic 53 also has a peak value of 57, standardized to 100, and has a beam angle of approximately 25°. FIG. 3B shows that the second beam characteristic is free from an "optical hole" in its luminous intensity.

The invention claimed is:

1. A lamp-reflector unit comprising:

a reflector with a neck, a light emission window, a reflecting portion arranged around an optical axis extending through the neck and perpendicular to the light emission window, which reflecting portion extends from the neck up to the light emission window;

a lamp comprising, a first light source, and a second light source, said first and second light sources being located one behind the other, axially on the optical axis such that the first light source is located closer to the neck than the second light source;

a lamp cap mounted to the neck and provided with electrical contacts and with current conductors connected to the latter and to the respective light sources, characterized in that the reflecting portion is formed in accordance with a body of revolution about the optical axis of a curve which, seen in a longitudinal sectional view of the reflector through the optical axis, extends between a starting point on the neck and an end point on the light emission window, such that by means of auxiliary functions of:

a straight line section with n line points extending between the starting point and the end point;

a line section of a parabola with n parabola points extending between the starting point and the end point, having a parabola axis coinciding with the optical axis and having a focus F on the optical axis;

each individual point $K_n$ on the curve lies at a distance $x.D_n$ from a parabola point $P_n$ and at a distance $(1-x).D_n$ from a line point $L_n$, measured along a straight connecting line $V_n$ between $P_n$ and $L_n$, wherein $V_n$ lies in the plane of the longitudinal section and is perpendicular to the straight line section, wherein $D_n$ is the distance between $P_n$ and $L_n$ measured along $V_n$, and wherein x is substantially constant for the entire curve and has a value in a range of $0.25 \leqq x \leqq 0.75$.

2. A lamp-reflector unit as claimed in claim 1, characterized in that, viewed in the longitudinal section, a line through the starting point and the focus F encloses an angle $\alpha_1$ with the optical axis, and in that a further line through the end point and the focus F encloses an angle $\alpha_2$ with the optical axis, wherein $30° \leqq \alpha_1 \leqq 50°$ and $40° \leqq \alpha_2 \leqq 60°$.

3. A lamp-reflector unit as claimed in claim 1, characterized in that the lamp is fixed by an end portion in the neck of the reflector.

4. A lamp-reflector unit as claimed in claim 1, characterized in that the lamp is a low-voltage halogen incandescent lamp.

5. A lamp-reflector unit as claimed in claim 4, characterized in that the light sources are filaments which are each manufactured from a separate wire.

6. A lamp-reflector unit as claimed in claim 5, characterized in that the halogen incandescent lamp is a modified dual-filament halogen automobile lamp.

7. A lamp-reflector unit as claimed in claim 1, characterized in that the reflecting portion is subdivided into p facet rings, wherein the curve is approximated in that each facet ring p, seen in the longitudinal section, is oriented along a respective tangent line m to the curve halfway the relevant facet ring p.

8. A lamp-reflector unit as claimed in claim 1, characterized in that the reflecting portion is subdivided into r axial segments.

9. A lamp-reflector unit as claimed in claim 1, characterized in that the lamp has a translucent wall comprising a first and a second wall portion which surround the first and the second light source, respectively, wherein at least one wall portion has a spectrally modifying effect on light originating from the light source and passing through the relevant wall portion.

10. A lamp-reflector unit as claimed in claim 9, characterized in that at least one of the wall portions has a coating.

* * * * *